United States Patent [19]

Ponticello et al.

[11] 4,273,853

[45] Jun. 16, 1981

[54] METAL COMPLEXES OF COPOLYMERS COMPRISING VINYLIMIDAZOLE AND THEIR USE IN PHOTOGRAPHIC ELEMENTS

[75] Inventors: Ignazio S. Ponticello; Henry J. Sniadoch; George Villard, all of Rochester, N.Y.

[73] Assignee: Eastman Kodak Company, Rochester, N.Y.

[21] Appl. No.: 25,686

[22] Filed: Mar. 30, 1979

[51] Int. Cl.[3] ..... G03C 7/00; G03C 1/40; G03C 5/54

[52] U.S. Cl. ..... 430/213; 430/237; 430/238; 430/941

[58] Field of Search ..... 96/77, 73, 74, 119 R, 96/29 D; 430/213, 237, 238, 941; 428/500

[56] References Cited

U.S. PATENT DOCUMENTS

| | | | |
|---|---|---|---|
| 3,075,841 | 1/1963 | Lehman et al. | 96/77 |
| 3,709,690 | 1/1973 | Cohen et al. | 430/213 |
| 4,124,386 | 11/1978 | Yoshida et al. | 96/77 |
| 4,142,891 | 3/1979 | Baigrie et al. | 96/77 |

FOREIGN PATENT DOCUMENTS 1468460 3/1977 United Kingdom .

OTHER PUBLICATIONS

"Photographic Mordants", Ponticello et al., *Research Disclosure* No. 12044 4/1974, pp. 36–37.

"Cationic Quaternary . . . Review", *J. Macromol. Sci.—Chem.,* Hoover, A 4(6), 10/1970, pp. 1327–1417.

*Primary Examiner*—Richard L. Schilling

*Attorney, Agent, or Firm*—Arthur H. Rosenstein

[57] ABSTRACT

A photographic element comprises a support having thereon a layer containing a copolymer comprising a vinylimidazole in association with metal ions. The metal forms a novel complex with the polymer and photographic elements comprising these materials are useful in diffusion transfer processes, and particularly useful with metal-coordinating dyes such as chelating dyes or dye-forming materials to provide a metallized dye image.

15 Claims, No Drawings

METAL COMPLEXES OF COPOLYMERS COMPRISING VINYLIMIDAZOLE AND THEIR USE IN PHOTOGRAPHIC ELEMENTS

The present invention relates to novel complexes, methods and photographic elements containing copolymers having associated therewith metal ions.

The use of various dyes and dye-forming materials in photographic processes, and particularly in image-transfer processes, has been known for quite some time. In many cases, however, dye image stability has been a problem in that the dyes may tend to wander from the image-receiving layer after processing; be destroyed in dark reactions; or fade, due to light exposure over a period of time.

The use of metal complexes of some ortho substituted azo dyes in image transfer processes reduces fade, as these metallized dyes have been found to be extremely light resistant.

Premetallized dyes are described in U.S. Pat. Nos. 3,482,972, 3,453,107, 3,563,739, 3,597,200 and 3,705,184 wherein premetallized dye developers are coated in the image-forming element of an image transfer film unit and transferred to the receiving layer as a function of exposure. On development, these premetallized dyes then diffuse to an image-receiving layer. In some instances, a metallic salt can be in a receiving layer and the dye or dye-forming material can be metallizable, rather than premetallized. That is, the dye or dye-forming material contains groups which will chelate with the metal ions to form the metallized dyes in the receiver, such as described in U.S. Pat. Nos. 3,081,167, 3,196,014 and British Pat. Nos. 905,701 and 1,121,995.

It has been found that the metallizable dye approach has the advantages of faster diffusion, in some cases, and the ability to use the metallization as a dye hue shifting mechanism. The use of the metallizable dye or dye former, however, requires the use of a metallizing image-receiving layer. In many instances, coating the metal ions in the receiving layer results in metal ion wandering, which causes deleterious sensitometric effects in the light-sensitive emulsion layer and an increase in access time in image transfer processes due to premature metallization. Further, since the metal ion source would be located in the image-receiving layer, unwanted color and stain under basic or acidic conditions may occur.

In copending U.S. Application Ser. No. 944,477, filed Sept. 21, 1978 by Archie and Campbell, entitled "Photographic Elements Containing Polymers Which Coordinate with Metal Ions," a film unit is described which comprises a support, a coordinating dye such as a chelating dye or dye-forming material and a mordant-containing receiving layer, said mordant-containing receiving layer having associated therewith a polymer containing groups which form coordination complexes with metal ions and a source of said metal ions associated with the polymer. This reduces the diffusion of metal ions throughout the film unit, and still allows for rapid metallization of the dye or dye-forming material in the vicinity of the mordant.

British Pat. No. 1,468,460 describes a mordant for photographic use containing benzyl-substituted vinylimidazoles. The mordants are not described as being useful in the presence of metal ions.

It has been found that a photographic element and particularly a color image transfer unit which comprises a support having thereon a layer containing a copolymer comprising a partially quaternized vinylimidazole associated with metal ions will have enhanced picture quality, provide the desirable shift of dye hues and exhibit improved dye stability when using conventional non-metallizing dyes as well as coordinating or chelating dye or dye-forming materials.

A photographic element in accordance with our invention comprises a support having thereon a layer containing a polymer having recurring units:

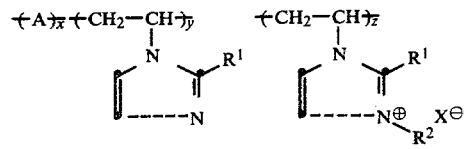

wherein:

A is a unit derived from an ethylenically unsaturated monomer;

$R^1$ is H, alkyl such as methyl, or alkyl substituted with a metal-coordinating group or salts thereof;

$R^2$ is alkyl or aralkyl;

$X^{\ominus}$ is an acid anion;

x is 10 to 80 mole percent;

y is 10 to 80 mole percent; and z is 0 to 40 mole percent;

said polymer having associated therewith metal ions.

The support for the photographic element can be any support material typically useful for photographic elements, such as those described on page 5 of the November 1976 edition of *Research Disclosure,* the disclosure of which is hereby incorporated by reference.

The copolymer used in this invention comprises from about 10 to about 80 mole percent of units of $\alpha,\beta$-ethylenically unsaturated monomers. In the preferred embodiment the copolymer comprises from about 30 to about 70 mole percent of the ethylenically unsaturated monomer.

Any ethylenically unsaturated monomer which is addition polymerizable is useful. As exemplary of such monomers may be listed: acrylic esters, such as methyl methacrylate, butyl acrylate, butyl methacrylate and ethyl acrylate; vinyl esters such as vinyl acetate; amides, such as acrylamide, diacetone acrylamide, N-methyl acrylamide and methacrylamide; nitriles, such as acrylonitrile and vinylphenylacetonitrile; ketones, such as methyl vinyl ketone, ethyl vinyl ketone and p-vinylacetophenone; halides, such as vinyl chloride, vinylidene chloride and vinylbenzyl chloride; ethers, such as methyl vinyl ether; ethyl vinyl ether and vinylbenzyl methyl ether; $\alpha,\beta$-unsaturated acids such as acrylic acid and methacrylic acid and other unsaturated acids such as vinylbenzoic acid; simple heterocyclic monomers such as vinylpyridine and vinylpyrrolidone; olefins, such as ethylene, propylene, butylene and styrene as well as substituted styrene; diolefins, such as butadiene and 2,3-dimethylbutadiene and the like, and other vinyl monomers within the knowledge and skill of an ordinary worker in the art.

$R^1$ is H, alkyl or alkyl substituted with a metal-coordinating group. The alkyl portion of $R^1$ preferably contains from 1 to 12 carbon atoms such as methyl, propyl, isobutyl, hexyl and the like. The alkyl can be substituted with a metal-coordinating, e.g., chelating group or salt thereof.

A metal-coordinating group as used herein is defined as a group which will form a coordinate bond with a metal, especially a transition metal. In preferred embodiments, more than one coordinating group is available to allow chelation of the metal and such pairs of groups are referred to as chelating or chelatable groups.

Examples of metal chelating groups or salts of metal chelating groups which can be substituted on the alkyl group include hydroxy, carboxy, cyano, bis(carboxyalkyl)amino such as bis(carboxymethyl)amino, bis(cyanoalkyl)amino such as bis(cyanomethyl)amino, and the ammonium or alkali metal salts of the carboxy-substituted alkyl groups such as sodium potassium, lithium, ammonium and the like salts;

$R^2$ is alkyl preferably containing from 1 to 12 carbon atoms such as methyl, ethyl, isobutyl, hexyl, decyl and the like including substituted alkyl such as hydroxymethyl, hydroxyethyl, hydroxypropyl, carboxyalkyl and like substituents and aralkyl containing from about 7 to about 10 carbon atoms such as benzyl, phenethyl, p-chlorobenzyl and the like.

In a preferred embodiment the vinylimidazole units comprise from 30 to 70 mole percent (y is 30 to 70 percent) and the quaternized vinylimidazole units comprise from about 5 to about 20 mole percent (z is 5 to 20 mole percent).

$X^{\ominus}$ is any acid anion such as chloride, bromide, methanesulfonate, p-toluenesulfonate, methosulfate, nitrate, acetate, sulfate and the like.

The copolymer is formed by any conventional copolymerization technique and can be carried out with or without a catalyst such as a potassium persulfate decomposition catalyst, a potassium persulfate-sodium bisulfite redox catalyst system, peroxides, e.g. benzoyl peroxide, azo catalysts, e.g. 2,2'-azobis(2-methylpropionitrile), and the like, preferably in a concentration of 0.5 to about 1.5 percent, based on total monomer, and at any temperature and pressure, but preferably at 60° to 120° C. and approximately at atmospheric pressure. The polymerization is preferably carried out in a solvent such as dimethylformamide, N-methylpyrrolidone and the like.

The polymer, in most instances, is itself a dye mordant. However, an image receiving layer comprising the polymer can also comprise an additional polymeric mordant for receiving the dye or dye-forming material. Preferred polymeric mordants include poly(vinylpyridine), poly(styrene-co-vinylbenzyl chloride-co-N-vinylbenzyl-N-benzyl-N,N-dimethylammonium chloride-co-divinylbenzene), poly(styrene-co-vinylbenzyl chloride-co-N-vinylbenzyl-N,N,N-trihexylammonium chloride), poly[styrene-co-N-(3-maleimidopropyl)-N-benzyl-N,N-dimethylammonium]chloride and the like. The polymer of this invention is generally coated in the layer with a hydrophilic binder such as gelatin, polyacrylamides, poly(vinylpyrrolidone) and the like. The polymer can be in a concentration of 0.5 g/m$^2$ to about 8 g/m$^2$, and the dye receiving layer can be of a thickness preferably from about 0.5 to about 10$\mu$.

As stated above, metal ions are associated with the polymer of this invention. By "associated with the polymer" it is meant that the metal ions can be either in the same layer as the polymer, or in an adjacent layer such that, by diffusion under alkaline conditions, the metal ions have easy access to the polymer. It is preferred that the metal ions be either in the same layer with the polymer or in a layer on the side of the polymer layer furthest from any photosensitive layers.

Metal ions useful in this invention are those which react speedily with the released dye or dye forming material to form a complex of the desired hue and form a dye complex which is stable to heat, light and chemical reagents. In general, good results are obtained with polyvalent metal ions such as copper(II), zinc(II), nickel(II), platinum(II), palladium(II) and cobalt(II) ions. Most preferred are the transition metal ions and especially preferred are nickel(II), copper(II), zinc and cobalt.

The metal ion source for incorporation into the element can be any solution of a salt of a metal ion in water. Water-soluble salts useful herein include nickel salts, such as nickel sulfate, nickel nitrate, nickel acetate, nickel chloride, and the like; copper salts, such as copper nitrate, copper sulfate, copper chloride, copper acetate, zinc and cobalt salts and the like.

A binder for the metal salt can be used. The binder for the metal salt can be any hydrophilic binder, such as gelatin, poly(acrylamide), poly(vinyl alcohol), poly(vinyl pyrrolidone), hydroxyethyl cellulose, and the like. The metal salt, generally in a coverage of from about 13.5 to about 108 mg/ft$^2$, binder and water can be mixed with a suitable surfactant, such as Surfactant 10G (p-isononylphenoxypolyglycidol) and coated as a layer using any convenient method of coating, such as brush coating, roll coating and the like. Although the thickness of the layer is not critical, the layer is generally from about 0.4$\mu$ to about 1.6$\mu$.

The metal ions described above form a novel coordination compound with the polymer of this invention. The term "coordinate to" as used herein refers to electron donating organic materials sharing electron pairs with electron accepting metal cations. The stability constant for the complex of a polymer and the metal ion is determined by measuring the concentrations of polymer ligand-metal complex, free polymer ligand, and free metal ion at a pH of about 5 or higher, and by applying the equations:

$$M + L = ML \quad \beta_1 = \frac{[ML]}{[M][L]}$$

$$M + 2L = ML_2 \quad \beta_2 = \frac{[ML_2]}{[M][L]^2}$$

$$M + 3L = ML_3 \quad \beta_3 = \frac{[ML_3]}{[M][L]^3}$$

$$\vdots$$

$$M + NL - ML_N \quad \beta_N = \frac{[ML_N]}{[M][L]^N}$$

where M is the concentration of the metal ion, L is the concentration of the polymer ligand, and $\beta$ is the overall stability constant, as described in F. A. Cotton and G. Wilkinson, *Advanced Inorganic Chemistry*, Interscience, New York, 1967. The stability constant for a particular metal ion with a particular polymer containing coordinating groups can be found by quantifying the species mentioned above. In order to be effective, the stability constant of the polymer and metal ion should be at least $10^{10}$, and preferably at least $10^{15}$ to $10^{18}$.

The amount of metal ions used is that which is sufficient to provide each metal-coordinating group on the polymer with up to about one metal ion.

The metal and polymer also form a novel complex with a chelating dye or dye forming material, if one is present. The ultimate image comprising the complex is very stable both with respect to fading and to lateral diffusion.

The resulting coated support can be used in a variety of photographic elements where a dye image is eventually desired. The photographic element preferably contains a dye or dye-forming material which will, on contact with the metallized polymer, coordinate or interact with the metal and polymer to form a stable dye image.

The dye or dye former can be any conventional dye or dye-forming material, such as those described in U.S. Pat. Nos. 4,013,633; 4,001,204 and 3,954,476. In a preferred embodiment, the dye or dye former is a metal chelating dye or dye former.

Generally, any acid dye or dye-forming material containing the above chelating groups will be useful herein as the metallizable dye or dye forming material. Examples of such dyes are those dye developers described in U.S. Pat. Nos. 3,081,167 and 3,196,014, and British Pat. Nos. 905,701 and 1,121,995. Examples of azo dyes useful herein are dihydroxyazo, pyridylhydroxyazo, aminohydroxyazo, pyridylsulfonamidoazo, hydroxyisopyridylazo and the like.

Useful dye-forming materials include redox dye releasers containing dye moieties containing the chelating groups. These dye-forming materials are disclosed in U.S. Pat. No. 4,142,891 issued Mar. 6, 1979 by B. D. Baigrie et al. The nondiffusible compounds having a releasable azo dye moiety generally can have the formula:

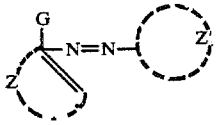

wherein:

Z represents the atoms necessary to complete an aromatic carbocyclic or heterocyclic nucleus having at least one ring of 5 to 7 atoms, such as phenyl, pyridyl, naphthyl, pyrazolyl, indolyl, etc;

Z' is an aromatic carbocyclic or heterocyclic nucleus having at least one ring having 5 to 7 atoms (e.g., the same nuclei as described above for Z), the Z' having in a position adjacent to the point of attachment to the azo linkage either:

(a) a nitrogen atom in the ring of the nucleus which acts as a coordinating site; or (b) a carbon atom in the ring of the nucleus having attached thereto a nitrogen atom, either directly or indirectly such as in a sulfamoyl group, which acts as a chelating site;

G is a metal-coordinating group (any group which will donate a pair of electrons to a metal ion) or a salt thereof (e.g. an alkali metal salt, a quaternary ammonium salt, etc) or a hydrolyzable precursor thereof (e.g., a hydrolyzable acyl or ester group), e.g. hydroxy; amino; carboxy; sulfonamido; sulfamoyl; a hydrolyzable ester group having the formula —$OCOR^1$, —$OCOOR^1$, —$OCON(R^1)_2$ or —$COOR^1$, wherein $R^1$ is an alkyl group having 1 to about 4 carbon atoms, such as methyl, ethyl, isopropyl, butyl and the like, or an aryl group having 6 to about 8 carbon atoms, such as phenyl, etc; or a group which together with $$-\overset{\overset{\displaystyle O}{\|}}{C}-O$$

is a ballasted carrier moiety (as defined below) which is attached to the Z-nucleus through the oxygen of the $$-\overset{\overset{\displaystyle O}{\|}}{C}-O$$

group; the compound containing a ballasted carrier moiety capable of releasing the diffusible azo dye, under alkaline conditions, such as, for example, as a function (either direct or inverse) of development of the silver halide emulsion layer.

In the above formula, G can be either a monovalent group or a nitrogen atom as part of a heterocyclic ring fused to Z. In this later instance, the Z and G atoms can form a nucleus which is the same as the Z' nucleus.

There is great latitude in selecting a carrier moiety which is attached to the azo dye-releasing compounds described above. Depending upon the nature of the ballasted carrier selected, various groups may be needed to attach or link the carrier moiety to the azo dye. Such linking groups are considered to be a part of the CAR moiety in the definition below. It should also be noted that when the dye moiety is released from the compound, cleavage may take place in such a position that part or all of a linking group if one is present, and even part of the ballasted moiety may be transferred to the image-receiving layer along with the dye moiety. In any event, the azo dye nucleus, as shown above, can be thought of as the "minimum" which is transferred.

CAR moieties according to the invention are described in U.S. Pat. Nos. 3,227,550; 3,628,952; 3,227,552; and 3,844,785 (dye released by chromogenic coupling); U.S. Pat. Nos. 3,443,939 and 3,443,940 (dye released by intramolecular ring closure); U.S. Pat. Nos. 3,698,897 and 3,725,062 (dye released from hydroquinone derivatives); U.S. Pat. No. 3,728,113 (dye released from a hydroquinonylmethyl quaternary salt); U.S. Pat. Nos. 3,719,489 and 3,443,941 (silver ion induced dye release); and U.S. Pat. Nos. 3,245,789 and 3,980,497; Canadian Pat. No. 602,607; British Pat. No. 1,464,104; *Research Disclosure* 14447, April 1976; and U.S. Pat. No. 4,139,379 issued Feb. 13, 1979 of Chasman et al (dye released by miscellaneous mechanisms).

In a further preferred embodiment, the ballasted carrier moiety or CAR as described below may be represented by the following formula:

(Ballast-Carrier-Link)— wherein:

(a) Ballast is an organic ballasting radical of such molecular size and configuration as to render the compound nondiffusible in a photographic element during development in an alkaline processing composition;

(b) Carrier (CAR) is an oxidizable acrylic, carbocyclic or heterocyclic moiety (see "The Theory of the Photographic Process", by C. E. K. Mees and T. H. James, Third Edition, 1966, pages 282 to 283), e.g., moieties containing atoms according to the following configuration:

(a)—(—C=C)$_b$— wherein:

b is a positive integer of 1 to 2; and a represents the radicals OH, SH, NH—, or hydrolyzable precursors thereof; and (c) Link represents a group which upon oxidation of said Carrier moiety is capable of being hydrolytically cleaved to release the diffusible azo dye. For example, Link may be the following groups:

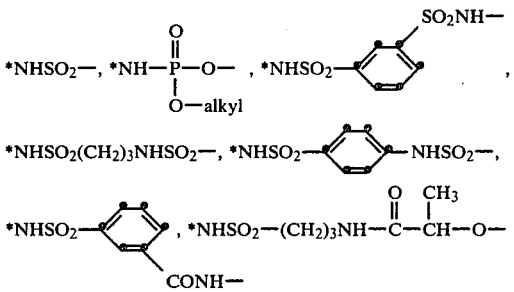

wherein * represents the position of attachment to Carrier.

The Ballast group in the above formula is not critical as long as it confers nondiffusibility to the compound. Typical Ballast groups include long-chain alkyl radicals linked directly or indirectly to the compound as well as aromatic radicals of the benzene and naphthalene series indirectly attached or fused directly to the carbocyclic or heterocyclic nucleus, etc. Useful Ballast groups generally have at least 8 carbon atoms such as substituted or unsubstituted alkyl groups of 8 to 22 carbon atoms, a carbamoyl radical having 8 to 30 carbon atoms such as —CONH(CH$_2$)$_4$—O—C$_6$H$_3$(C$_5$H$_{11}$)$_2$, —CON(C$_{12}$H$_{25}$)$_2$, etc, a keto radical having 8 to 30 carbon atoms such as —CO—C$_{17}$H$_{35}$, —CO—C$_6$H$_4$-(t—C$_{12}$H$_{25}$), etc.

For specific examples of Ballast-Carrier-Link moieties useful as the CAR moiety according to this invention, reference is made to the November 1976 edition of *Research Disclosure,* pages 68 through 74, and the April 1977 edition of *Research Disclosure,* pages 32 through 39, the disclosures of which are hereby incorporated by reference.

In a highly preferred embodiment of the invention, the ballasted carrier moiety or CAR is a group having the formula:

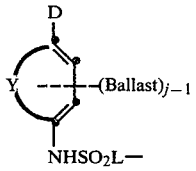

wherein:

(a) Ballast is an organic ballasting radical of such molecular size and configuration (e.g., simple organic groups or polymeric groups) as to render the compound nondiffusible in a photographic element during development in an alkaline processing composition;

(b) D is OR$^2$ or NHR$^3$ wherein R$^2$ is hydrogen or a hydrolyzable moiety and R$^3$ is hydrogen or a substituted or unsubstituted alkyl group of 1 to 22 carbon atoms such as methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, dodecyl, benzyl, phenethyl, etc. (when R$^3$ is an alkyl group of greater than 8 carbon atoms, it can serve as a partial or sole Ballast);

(c) Y represents the atoms necessary to complete a benzene nucleus, a naphthalene nucleus, or a 5- to 7-membered heterocyclic ring, such as pyrazolone, pyrimidine, etc;

(d) j is a positive integer of 1 to 2 and is 2 when D is OR$^2$ or when R$^3$ is hydrogen or an alkyl group of less than 8 carbon atoms; and (e) L is a linking group which is [X—(NR$^4$—J)$_q$]$_m$— or X—J—NR$^4$— wherein:

(i) X represents a bivalent linking group of the formula —R$^5$—L'$_n$—R$^5_p$— where each R$^5$ can be the same or different and each represents an alkylene radical having 1 to about 8 carbon atoms, such as methylene, hexylene and the like; a phenylene radical; or a substituted phenylene radical having 6 to about 9 carbon atoms, such as methoxyphenylene;

(ii) L' represents a bivalent radical selected from oxy, carbonyl, carboxamido, carbamoyl, sulfonamido, ureylene, sulfamoyl, sulfinyl or sulfonyl;

(iii) n is an integer of 0 or 1;

(iv) p is 1 when n equals 1 and p is 1 or 0 when n equals 0, provided that when p is 1 the carbon content of the sum of both R$^5$ radicals does not exceed 14 carbon atoms;

(v) R$^4$ represents a hydrogen atom, or an alkyl radical having 1 to about 6 carbon atoms;

(vi) J represents a bivalent radical selected from sulfonyl or carbonyl;

(vii) q represents an integer of 0 or 1; and (viii) m represents an integer of 0, 1 or 2.

Especially good results are obtained when D is OH, j is 2, Y is a naphthalene nucleus, and G is OH.

Examples of the ballasted CAR moiety in this highly preferred embodiment are disclosed in U.S. Pat. No. 4,076,529 issued Feb. 28, 1978 of Fleckenstein et al; U.S. Pat. No. 3,928,312; French Pat. No. 2,284,140; and German Pat. Nos. 2,406,664; 2,613,005; and 2,505,248, the disclosures of which are hereby incorporated by reference, and include the following:

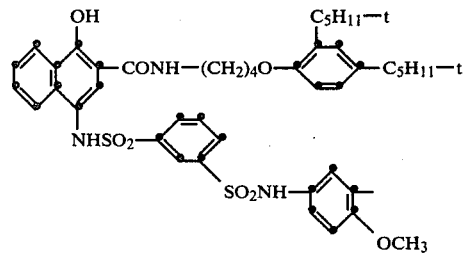

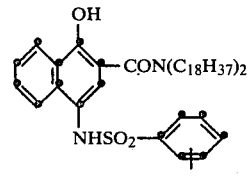

-continued

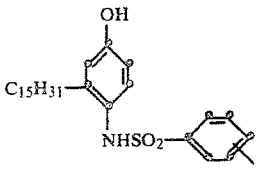

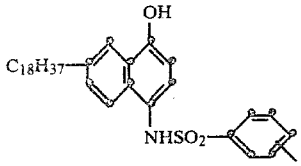

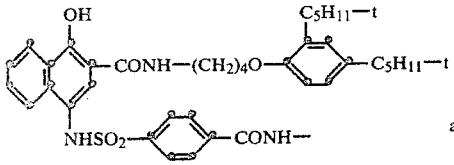

and

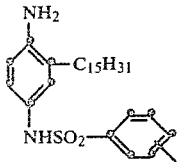

In another highly preferred embodiment, the ballasted carrier moiety or CAR is such that the diffusible azo dye is released as an inverse function of development of the silver halide emulsion layer under alkaline conditions. This is ordinarily referred to as positive-working dye-release chemistry. In one of these embodiments, the ballasted carrier moiety or CAR in the above formulas may be a group having the formula:

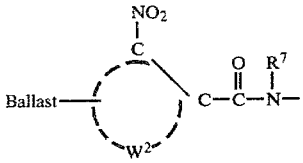

(I)

wherein:

Ballast is an organic ballasting radical of such molecular size and configuration as to render the compound non-diffusible in a photographic element during development in an alkaline processing composition;

$W^2$ represents at least the atoms necessary to complete a benzene nucleus (including various substituents thereon); and $R^7$ is an alkyl (including substituted alkyl) radical having 1 to about 10 carbon atoms.

Examples of the CAR moiety in this formula I include the following:

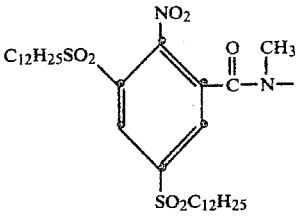

and

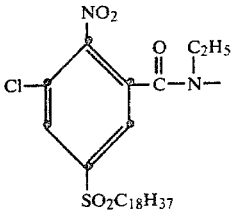

In a second embodiment of positive-working dye-release chemistry as referred to above, the ballasted carrier moiety or CAR may be a group having the formula:

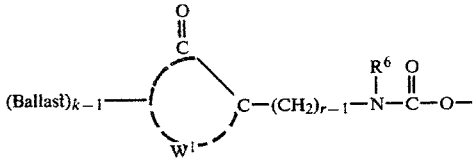

(II)

wherein:

Ballast is an organic ballasting radical of such molecular size and configuration as to render the compound nondiffusible in a photographic element during development in an alkaline processing composition;

$W^1$ represents at least the atoms necessary to complete a quinone nucleus (including various substituents thereon);

r is a positive integer of 1 or 2;

$R^6$ is an alkyl (including substituted alkyl) radical having 1 to about 40 carbon atoms or an aryl (including substituted aryl) radical having 6 to about 40 carbon atoms; and k is a positive integer of 1 to 2 and is 2 when $R^6$ is a radical of less than 8 carbon atoms.

Examples of the CAR moiety in formula II include the following:

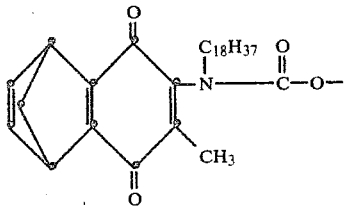

and

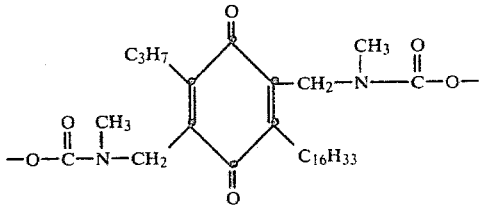

In using the compounds in formulas I and II above, they are employed in a photographic element similar to the other nondiffusible dye-releasers described previously. Upon reduction of the compound as a function of silver halide development under alkaline conditions, the metallizable azo dye is released. In this embodiment, conventional negative-working silver halide emulsions, as well as direct-positive emulsions, can be employed. For further details concerning these particular CAR moieties, including synthesis details, reference is made to U.S. Pat. No. 4,139,379 issued Feb. 13, 1979 of Chasman et al.

In a third embodiment of positive-working dye-release chemistry as referred to above, the ballasted carrier moiety or CAR may be a group having the formula:

(III)

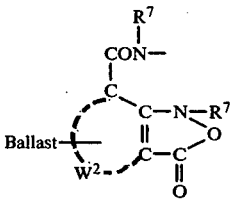

wherein:

Ballast, $W^2$ and $R^7$ are as defined for formula I above.

Examples of the CAR moiety in formula III include the following:

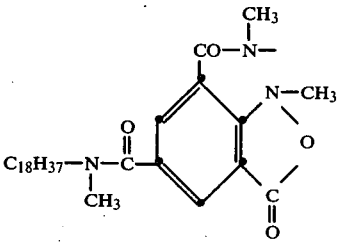

and

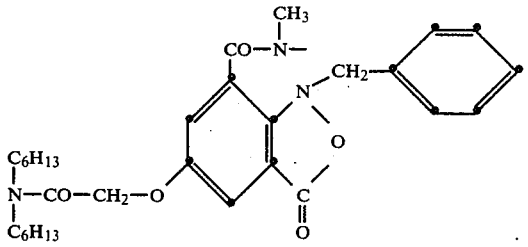

For further details concerning this particular CAR moiety, including synthesis details, reference is made to U.S. Pat. No. 4,199,354 issued Apr. 24, 1980.

In a fourth embodiment of positive-working dye-release chemistry as referred to above, the ballasted carrier moiety or CAR may be a group having the formula:

(IV)

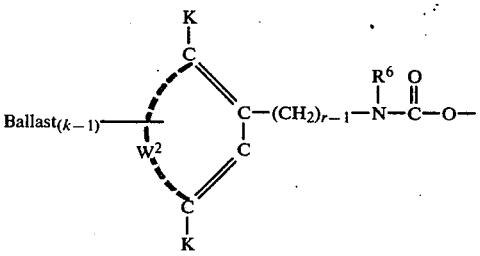

wherein:

Ballast, r, $R^6$ and k are as defined for formula II above;

$W^2$ is as defined for formula I above; and

K is OH or a hydrolyzable precursor thereof.

Examples of the CAR moiety in formula IV include the following:

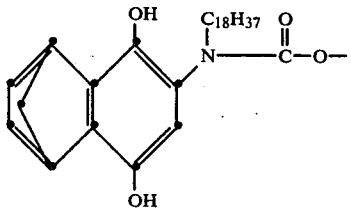

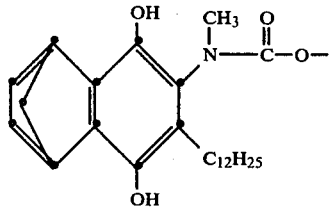

For further details concerning this particular CAR moiety, including synthesis details, reference is made to U.S. Pat. No. 3,980,479 of Fields et al, issued Sept. 14, 1976, the disclosure of which is hereby incorporated by reference.

Representative compounds useful with the polymers of our invention include the following:

(1)
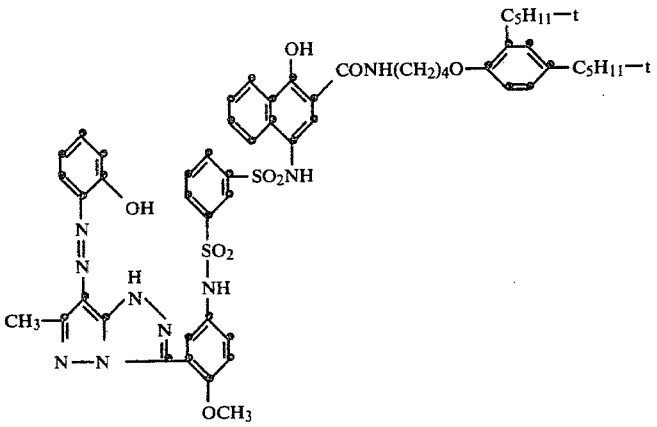
(2)
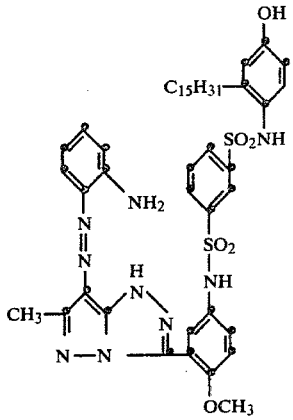
(3)
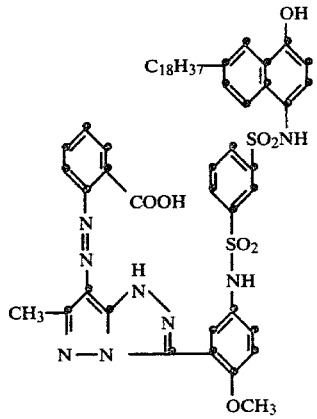
(4)
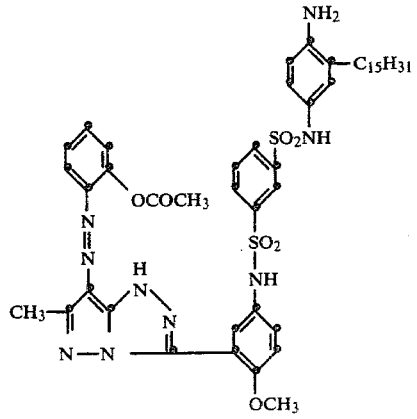

-continued
(5)
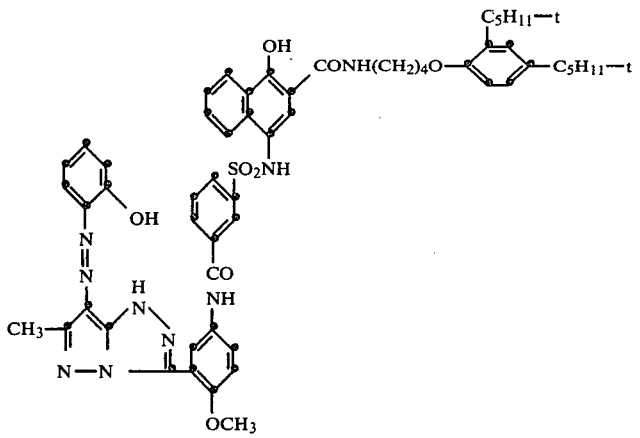
(6)
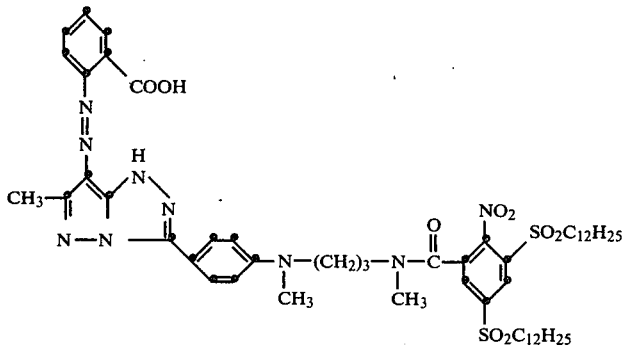
(7)
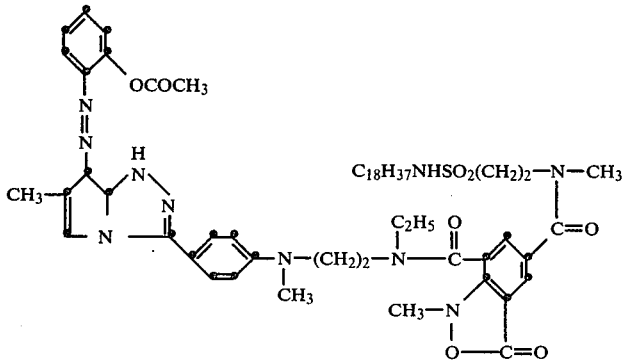
(8)
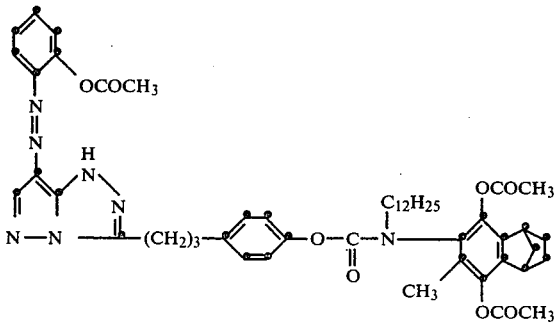

-continued
(9)
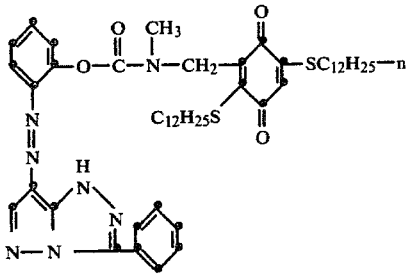
(10)
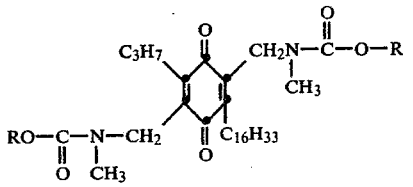
R =
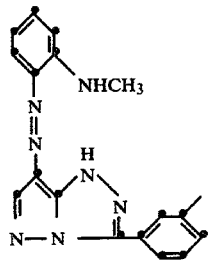
(11)
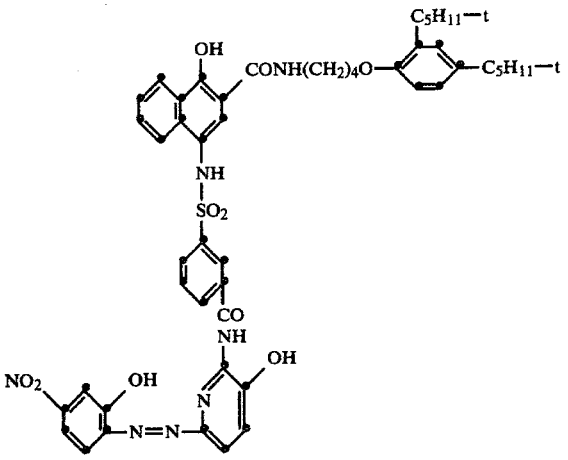
(12)
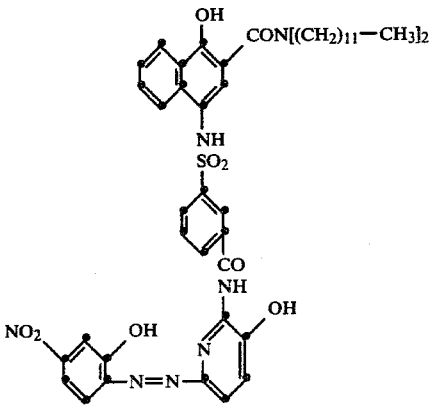

-continued
(13)
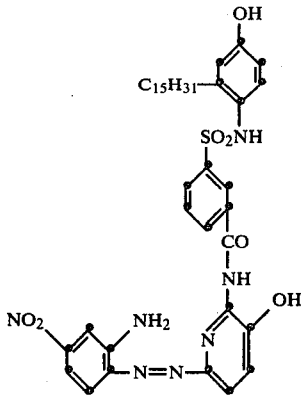
(14)
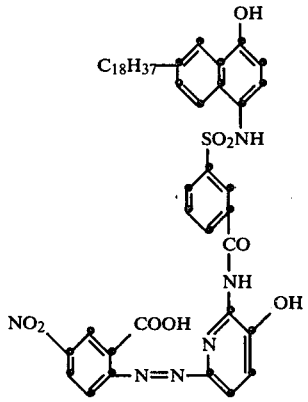
(15)
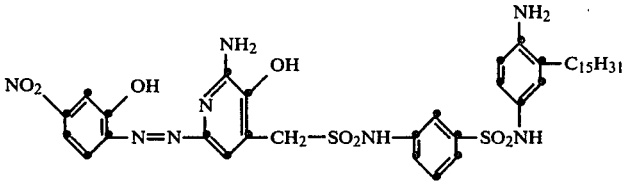
(16)
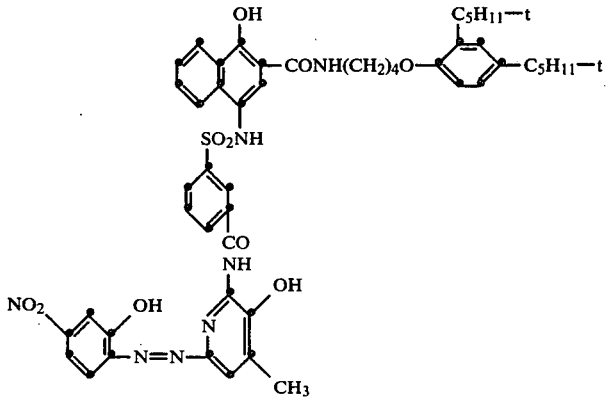
(17)
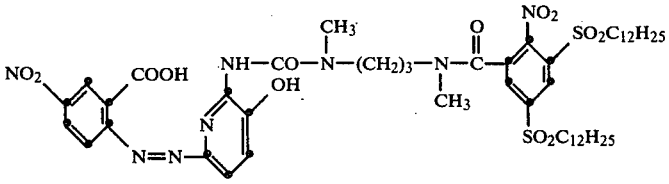

-continued
(18)
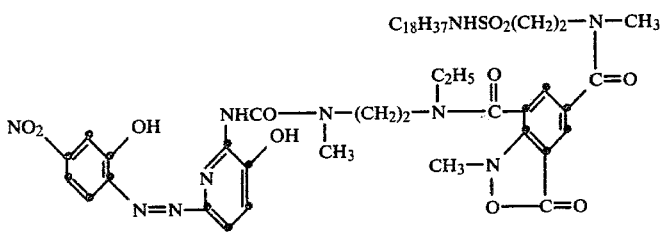
(19)
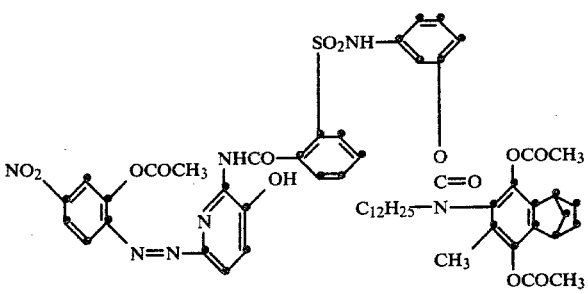
(20)
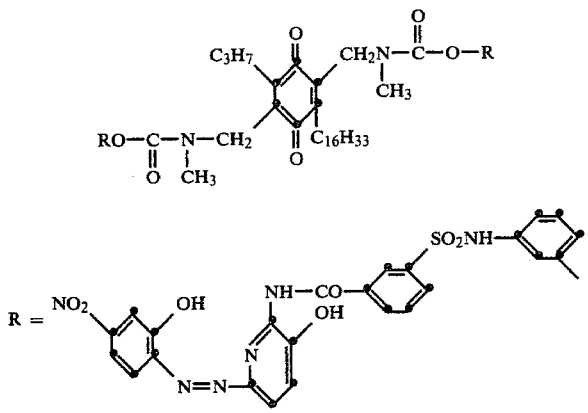
(21)
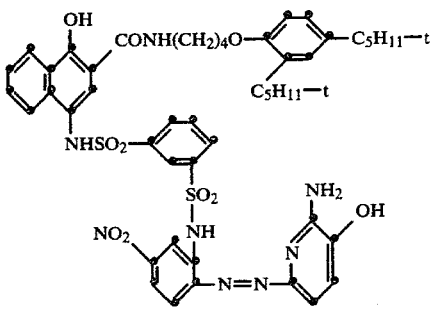
(22)
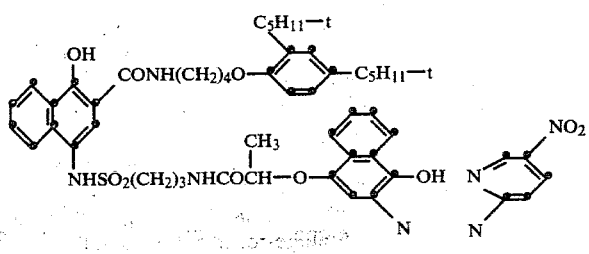

-continued (23)

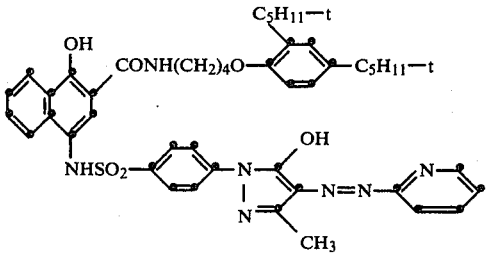

(24)

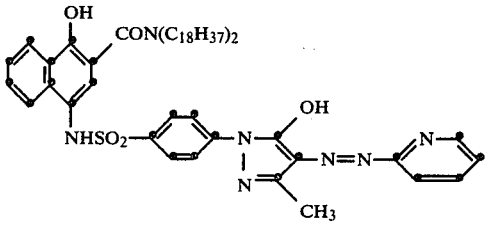

(25)

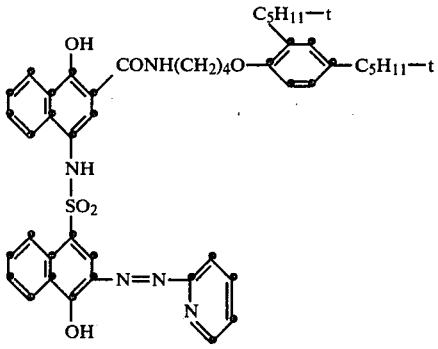

(26)

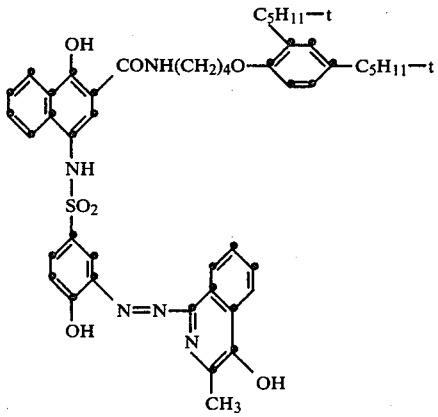

In a preferred embodiment, the photographic element containing the mordant layer, polymer with coordinating groups and metal ions is a dye image receiving element designed for use in an image transfer process.

An image transfer film unit of the invention can thus comprise:

(1) a support containing thereon at least one layer containing a photosensitive silver halide emulsion having associated therewith a dye or dye forming material, preferably a chelating dye or dye-forming material;

(2) a dye image receiving layer; and (3) an alkaline processing composition and means for discharging the same within said film unit in contact with said photosensitive layer;

wherein the dye image receiving layer contains the copolymer of this invention in association with metal ions.

The photographic element in the above-described film unit can be treated with an alkaline processing composition to effect or initiate development in any manner. A preferred method for applying processing composition is by use of a rupturable container or pod which contains the composition. In general, the processing composition employed in this invention contains the developing agent for development, although the composition could also just be an alkaline solution where the developer is incorporated in the photographic element, image-receiving element or process sheet, in which case the alkaline solution serves to activate the incorporated developer.

The photographic film unit which can be processed in accordance with this invention is adapted to be processed by passing the unit between a pair of juxtaposed pressure-applying members, such as would be found in a camera designed for in-camera processing wherein the means for discharging alkaline processing composition within the film unit, such as a rupturable container which is adapted to be positioned during processing of the film unit so that a compressive force applied to the container by the pressure-applying members will effect a discharge of the container's contents within the film unit.

It is therefore a further embodiment of this invention to provide an image transfer film unit to be processed by an alkaline processing composition, said film unit comprising a dye image receiving layer which contains a polymer having the recurring units

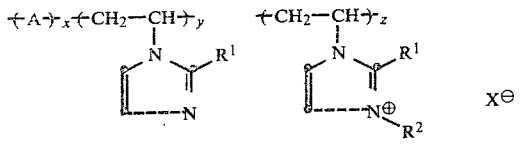

wherein:

A is a unit derived from an ethylenically unsaturated monomer;

$R^1$ is H, alkyl or alkyl substituted with a metal-coordinating group or salts thereof;

$R^2$ is alkyl or aralkyl;

$X^{\ominus}$ is an acid anion;

x is 10 to 80 mole percent;

y is 10 to 80 mole percent; and z is 0 to 40 mole percent;

said polymer having associated therewith metal ions.

It will be appreciated that, after processing the photographic element described above, there remains in it after transfer has taken place an imagewise distribution of chelating dye in addition to developed silver. A color image comprising residual nondiffusible compound may also be obtained by this process if the residual silver and silver halide are removed by any conventional manner well known to those skilled in the photographic art, such as a bleach bath followed by a fix bath, a bleach-fix bath, etc. Such a retained dye image should normally be treated with metal ions to metallize the dyes to increase their light fastness and shift their spectral absorption to the intended region. If a negative-working silver halide emulsion is employed in certain preferred photosensitive elements, described above, then a positive color image, such as a reflection print, a color transparency or motion picture film, may be produced in this manner. If a direct-positive silver halide emulsion is employed in such photosensitive elements, then a negative color image may be produced.

In the film unit described above, the dye image-receiving layer may itself contain metal ions or the metal ions may be present in an adjacent layer, so that the dye or dye forming material which is released will form a coordination complex therewith. The dye thus becomes immobilized in the dye image-receiving layer and if it is a chelating dye becomes metallized at the same time. The formation of the coordination complex may shift the absorption of the dye to the desired hue, usually to longer wavelengths, which have a different absorption than that of the initial dye-releasing compound. If this shift is large enough, then the dye-releasing compound may be incorporated in a silver halide emulsion layer without adversely affecting its sensitivity. The dyes may also be shifted in a variety of ways well known in the art.

The dye image-receiving layer in the above-described film unit can be located on a separate support adapted to be superposed on the photographic element after exposure thereof. Such image-receiving elements are generally disclosed, for example, in U.S. Pat. No. 3,362,819. When a means for discharging the processing composition is a rupturable container, it is usually positioned in relation to the photographic element and the image-receiving element so that a compressive force applied to the container by pressure-applying members, such as would be found in a typical camera used for in-camera processing, will effect a discharge of the container's contents between the image-receiving element and the outermost layer of the photographic element. After processing, the dye image-receiving element is separated from the photographic element.

The dye image-receiving layer in the above-described film unit can also be located integral with the photographic element between the support and the lowermost photosensitive silver halide emulsion layer. One useful format for integral receiver-negative photographic elements is disclosed in Belgian Patent No. 757,960. In such an embodiment, the support for the photographic element is transparent and is coated with an image-receiving layer, a substantially opaque light-reflective layer, e.g., $TiO_2$, and then the photosensitive layer or layers described above. After exposure of the photographic element, a rupturable container containing an alkaline processing composition and an opaque process sheet are brought into superposed position. Pressure-applying members in the camera rupture the container and spread processing composition between the photographic element and an opaque cover sheet as the film unit is withdrawn from the camera. The processing composition develops each exposed silver halide emulsion layer and dye images are formed as a function of development which diffuse to the image-receiving layer to provide a positive, right-reading image which is viewed through the transparent support on the opaque reflecting layer background. For other details concerning the format of this particular integral film unit, reference is made to the above-mentioned Belgian Pat. No. 757,960.

Another format for integral negative-receiver photographic elements in which the present invention can be employed is disclosed in Belgian Pat. No. 757,959. In this embodiment, the support for the photographic element is transparent and is coated with the image-receiving layer, a substantially opaque, light-reflective layer and the photosensitive layer or layers described above. A rupturable container containing an alkaline processing composition and an opacifier is positioned adjacent the top layer and a transparent top sheet which has thereon a neutralizing layer and a timing layer. The film unit is placed in a camera, exposed through the transparent top sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images are formed as a result of development which diffuse to the image-receiving layer to provide a positive, right-reading image which is viewed through the transparent support on the opaque reflecting layer background. For further details concerning the format of this particular integral film unit, reference is made to the above-mentioned Belgian Pat. No. 757,959.

Still other useful integral formats in which this invention can be employed are described in U.S. Pat. Nos. 3,415,644; 3,415,645; 3,415,646; 3,647,437; and 3,635,707. In most of these formats, a photosensitive silver halide emulsion is coated on an opaque support and a dye image-receiving layer is located on a separate transparent support superposed over the layer outermost from the opaque support. In addition, this transparent support also preferably contains a neutralizing layer and a timing layer underneath the dye image-receiving layer.

Another embodiment of the invention uses the image-reversing technique disclosed in British Pat. No. 904,364, page 19, lines 1 through 41. In this process, the dye-releasing compounds are used in combination with physical development nuclei in a nuclei layer contiguous to the photosensitive silver halide negative emulsion layer. The film unit contains a silver halide solvent, preferably in a rupturable container with the alkaline processing composition.

The film unit or assembly used in the present invention may be used to produce positive images in single- or multicolors. In a three-color system, each silver halide emulsion layer of the film assembly will have associated therewith a dye-releasing compound which releases a dye possessing a predominant spectral absorption within the region of the visible spectrum to which said silver halide emulsion is sensitive (initially or after forming the coordination complex), i.e., the blue-sensitive silver halide emulsion layer will have a yellow or yellow-forming dye-releaser associated therewith, the green-sensitive silver halide emulsion layer will have a magenta or magenta-forming dye-releaser associated therewith, and the red-sensitive silver halide emulsion layer will have a cyan or cyan-forming dye-releaser associated therewith. The dye-releaser associated with each silver halide emulsion layer may be contained either in the silver halide emulsion layer itself, or in a layer contiguous to the silver halide emulsion layer.

The concentration of dye-releasing compounds that can be employed in the present invention may be varied over a wide range, depending upon the particular compound employed and the results which are desired. For example, dye-releasers may be coated in layers by using coating solutions containing between about 0.5 and about 8 percent by weight of the dye-releaser distributed in a hydrophilic film-forming natural material or synthetic polymer, such as gelatin, poly(vinyl alcohol), etc, which is adapted to be permeated by aqueous alkaline processing composition.

Depending upon which CAR is used in the dye-releasing compound, a variety of silver halide developing agents can be employed. In certain embodiments of the invention, any silver halide developing agent can be employed as long as it cross-oxidizes with the dye-releasers described herein. The developer may be employed in the photosensitive element to be activated by the alkaline processing composition. Specific examples of developers which can be employed in this invention include:

N-methylaminophenol
Phenidone (1-phenyl-3-pyrazolidone)
Dimezone (1-phenyl-4,4-dimethyl-3-pyrazolidone) aminophenols
1-phenyl-4-methyl-4-hydroxymethyl-3-pyrazolidone
N,N-diethyl-p-phenylenediamine
N,N,N',N'-tetramethyl-p-phenylenediamine
3-methyl-N,N-diethyl-p-phenylenediamine
3-methoxy-N-ethyl-N-ethoxy-p-phenylenediamine, etc.

The non-chromogenic developers in this list are preferred, however, since they avoid any propensity of staining the dye image-receiving layer.

In one of the preferred embodiments of the invention, the silver halide developer employed in the process becomes oxidized upon development and reduces silver halide to silver metal. The oxidized developer then cross-oxidizes the dye-releasing compound. The product of cross-oxidation then undergoes alkaline hydrolysis, thus releasing an image-wise distribution of diffusible azo dye which then diffuses to the receiving layer to provide the dye image. The diffusible moiety is transferrable in alkaline processing composition either by virtue of its self-diffusivity or by having attached to it one or more solubilizing groups, for example, a carboxy, sulpho, sulphonamido, hydroxy or morpholino group.

In using dye-releasing compounds which produce diffusible dye images as a function of development, either conventional negative-working or direct-positive silver halide emulsions may be employed. If the silver halide emulsion employed is a direct-positive silver halide emulsion, such as an internal-image emulsion designed for use in the internal image reversal process or a fogged, direct-positive emulsion such as a solarizing emulsion, which is developable in unexposed areas, a positive image can be obtained in certain embodiments on the dye image-receiving layer. After exposure of the film unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye-releasing compounds and the oxidized form of the compounds then undergoes a base-catalyzed reaction to release the dyes imagewise as a function of the imagewise exposure of each of the silver halide emulsion layers. At least a portion of the imagewise distributions of diffusible dyes diffuse to the image-receiving layer to form a positive image of the original subject. After being contacted by the alkaline processing composition, a pH-lowering layer in the film unit or image-receiving unit lowers the pH of the film unit or image receiver to stabilize the image.

Internal-image silver halide emulsions useful in this invention are described more fully in the November 1976 edition of *Research Disclosure,* pages 76 through 79, the disclosure of which is hereby incorporated by reference.

The various silver halide emulsion layers of a color film assembly employed in this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that may be transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention can be of the type disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed in gelatin and are about 0.6 to 6 microns in thickness; the dye-releasers are dispersed in an aqueous alkaline solution-permeable polymeric binder, such as gelatin, as a separate layer about 0.2 to 7 microns in thickness; and the alkaline solution-permeable polymeric interlayers, e.g., gelatin, are about 0.2 to 5 microns in thickness. Of course, these thicknesses are approximate only and can be modified according to the product desired.

Scavengers for oxidized developing agent can be employed in various interlayers of the photographic elements of the invention. Suitable materials are disclosed on page 83 of the November 1976 edition of *Research Disclosure,* the disclosure of which is hereby incorporated by reference.

Use of a pH-lowering material in the film units employed in this invention will usually increase the stability of the transferred image. Generally, the pH-lowering material will effect a reduction in the pH of the image layer from about 13 or 14 to at least 11 and preferably 5 to 8 within a short time after imbibition. Suitable materials and their functioning are disclosed on pages 22 and 23 of the July 1974 edition of *Research Disclosure and pages* 35 through 37 of the July 1975 edition of *Research Disclosure,* the disclosures of which are hereby incorporated by reference.

A timing or inert spacer layer can be employed in the practice of this invention over the pH-lowering layer which "times" or controls the pH reduction as a function of the rate at which alkali diffuses through the inert spacer layer. Examples of such timing layers and their functioning are disclosed in the *Research Disclosure* articles mentioned in the paragraph above concerning pH-lowering layers.

The alkaline processing composition employed in this invention is the conventional aqueous solution of an alkaline material, e.g., alkali metal hydroxides or carbonates such as sodium hydroxide, sodium carbonates or an amine such as diethylamine, preferably providing a pH in excess of 11, and preferably containing a developing agent as described previously. Suitable materials and addenda frequently added to such compositions are disclosed on pages 79 and 80 of the November 1976 edition of *Research Disclosure,* the disclosure of which is hereby incorporated by reference.

While the alkaline processing composition used in this invention can be employed in a rupturable container, as described previously, to conveniently facilitate the introduction of processing composition into the film unit, other methods of inserting processing composition into the film unit could also be employed, e.g., interjecting processing solution with communicating members similar to hypodermic syringes which are attached either to a camera or camera cartridge. The processing composition may also be applied by means of a swab or by dipping in a bath, if so desired.

The alkaline solution-permeable, substantially opaque, light-reflective layer employed in certain embodiments of photographic film units used in this invention are described more fully in the November 1976 edition of *Research Disclosure,* page 82, the disclosure of which is hereby incorporated by reference.

The supports for the photographic elements used in this invention can be any material as long as it does not deleteriously affect the photographic properties of the film unit and is dimensionally stable. Typical flexible sheet materials are described on page 85 of the November 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone.

The silver halide emulsions useful in this invention, both negative-working and direct-positive ones, are well known to those skilled in the art and are described in *Product Licensing Index,* Volume 92, December 1971, publication 9232, page 107, paragraph I, "Emulsion types"; they may be chemically and spectrally sensitized as described on page 107, paragraph III, "Chemical sensitization," and pages 108 and 109, paragraph XV, "Spectral sensitization," of the above article; they can be protected against the production of fog and can be stabilized against loss of sensitivity during keeping by employing the materials described on page 107, paragraph V, "Antifoggants and stabilizers," of the above article; they can contain development modifiers, hardeners, and coating aids as described on pages 107 and 108, paragraph IV, "Development modifiers"; paragraph VII, "Hardeners"; and paragraph XII, "Coating aids," of the above article; they and other layers in the photographic elements used in this invention can contain plasticizers, vehicles and filter dyes described on page 108, paragraph XI, "Plasticizers and lubricants," and paragraph VIII, "Vehicles," and page 109, paragraph XVI, "Absorbing and filter dyes," of the above article; they and other layers in the photographic elements used in this invention may contain addenda which are incorporated by using the procedures described on page 109, paragraph XVII, "Methods of addition," of the above article; and they can be coated by using the various techniques described on page 109, paragraph XVIII, "Coating procedures," of the above article, the disclosures of which are hereby incorporated by reference.

The term "nondiffusing" as used herein has the meaning commonly applied to the term in photography and denotes materials that, for all practical purposes, do not migrate nor wander through organic colloid layers, such as gelatin, in an alkaline medium, in the photographic elements of the invention and preferably when processed in a medium having a pH of 11 or greater. The same meaning is to be attached to the term "immobile". The term "diffusible", as applied to the materials of this invention, has the converse meaning and denotes materials having the property of diffusing effectively through the colloid layers of the photographic elements in an alkaline medium in the presence of "nondiffusing" materials. "Mobile" has the same meaning.

In the preferred embodiment, the film unit is an integral film unit wherein the receiver, dye-forming layer and cover sheet are permanently attached to one another before, during and after processing.

The resulting mordant layer in the image transfer film unit comprises metal ions chelated to the polymer and containing a conventional dye. If a chelating dye or dye forming material is used, the mordant layer will comprise a complex of the metal ions to the polymer and to the dye or dye forming material.

The following examples are presented for a further understanding of the invention.

Polymers according to the invention were prepared in the following procedures:

Preparation 1

Poly(styrene-co-1-vinylimidazole)

A mixture of 1-vinylimidazole (37.6 g, 0.4 mole) and styrene (4.16 g, 0.4 mole) was treated with 0.4 g of 2,2'-azobis(2-methylpropionitrile) (AIBN) and kept at 75°-80° C. under nitrogen overnight. The formed polymer was dissolved in acetone and precipitated from solution with diethyl ether, filtered, washed and dried. The polymer had an inherent viscosity of 0.23 in acetone.

Yield: 27.0 g.

Analysis calculated for a 3:1 mole ratio: C, 86.0; H, 7.4; N, 6.9. Found: C, 83.2, H, 7.6; N, 6.7.

Preparation 2

Poly(methyl methacrylate-co-1-vinylimidazole)

A mixture of 1-vinylimidazole (38.0 g, 0.4 mole) and methyl methacrylate (40.0 g, 0.4 mole) in dimethyl sulfoxide (DMSO, 240 ml) was treated with AIBN (0.8 g) and kept at 60°-65° C. under nitrogen. After three hours, additional DMSO (100 ml) was added and the solution was heated at 60°-65° C. overnight. The formed polymer was precipitated from solution with diethyl ether, filtered, and dissolved in DMF at 12.0 percent solids.

Yield: 71 g.

Preparation 3

Poly(butyl acrylate-co-1-vinylimidazole)

A mixture of 1-vinylimidazole (19.0 g, 0.2 mole) and butyl acrylate (25.8 g, 0.2 mole) in DMSO (290 ml) was treated with AIBN (0.4 g) and kept at 60°-65° C. under nitrogen overnight. The formed polymer was precipitated from solution with diethyl ether, filtered, and dissolved in N,N-dimethylformamide (DMF) at 12.1 percent solids.

Yield: 38 g.

Preparation 4

Poly(benzyl methacrylate-co-1-vinylimidazole)

A mixture of 1-vinylimidazole (19.0 g, 0.2 mole) and benzyl methacrylate (35.0 g, 0.2 mole) in DMSO (140 ml) was treated with AIBN (0.4 g) and kept at 60°-65° C. under nitrogen overnight. The formed polymer was precipitated from solution with water, filtered, washed, dried in a vacuum oven at 40°-50° C. The polymer had an inherent viscosity of 0.28 in DMF.

Yield: 57 g.

Analysis calculated for a 1:1 mole ratio: C, 71.1; H, 6.7; N, 10.4. Found: C, 70.3; H, 6.9; N, 7.1.

Preparation 5

Poly(benzyl acrylate-co-1-vinylimidazole)

This polymer was prepared as above from 1-vinylimidazole (19.0 g, 0.2 mole), benzyl acrylate (32.0 g, 0.2 mole), AIBN (0.4 g) in DMSO (140 ml). The polymer had an inherent viscosity of 0.6 in DMF.

Yield: 46 g.

Analysis calculated for a 1:1 mole ratio: C, 70.3; H, 6.3; N, 10.9. Found: C, 69.8; H, 6.9, N, 9.1.

Preparation 6

Poly(vinylbenzyl alcohol-co-1-vinylimidazole)

A mixture of 1-vinylimidazole (57.0 g, 0.6 mole) and vinylbenzyl alcohol (40.2 g, 0.3 mole) in DMF (10 ml) was treated with AIBN (0.9 g) and kept at 60°-65° C. under nitrogen. After eight hours, additional DMF (50 ml) was added and heating was continued at 60°-65° C. overnight. The formed polymer was precipitated from solution with water, filtered, washed, and dried. The polymer had an inherent viscosity of 0.16 in DMF.

Yield: 65 g.

Analysis calculated for a 1:1 copolymer: C, 73.7; H, 7.1; N, 12.3. Found: C, 73.0; H, 8.2; N, 11.1.

Quaternization

Polymers prepared as described above were quaternized by the following general procedure for quaternization of copolymers of 1-vinylimidazole. A solution of about 25 percent of imidazole polymer in DMF was treated with the stoichiometric amount of an appropriate organic halide required to give the desired degree of quaternization, and heated at 80°-90° C. under nitrogen overnight. The polymer was isolated by precipitation in ethyl acetate, filtered, washed, and dried. The results are summarized in Table I.

TABLE I

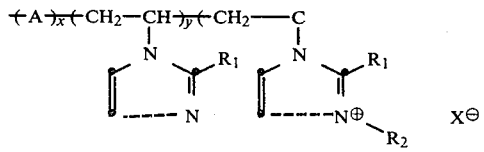

| Polymer No. | A | $R_1$ | $R_2$ | $X^{\ominus}$ | Mole Percent x | y | z |
|---|---|---|---|---|---|---|---|
| 1 | styrene | H | $C_6H_5CH_2$ | Cl | 75 | 0 | 25 |
| 2 | styrene | H | $C_6H_{13}$ | Br | 75 | 0 | 25 |

TABLE I-continued

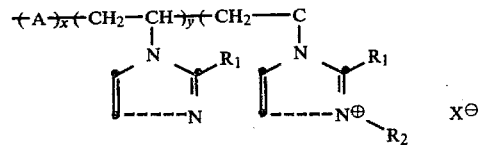

| Polymer No. | A | $R_1$ | $R_2$ | $X^{\ominus}$ | Mole Percent x | y | z |
|---|---|---|---|---|---|---|---|
| 3 | styrene | H | $C_6H_5CH_2$ | Cl | 60 | 30 | 10 |
| 4 | styrene | $CH_3$ | $C_6H_5CH_2$ | Cl | 50 | 37.5 | 12.5 |
| 5 | styrene | H | $C_6H_5CH_2$ | Cl | 60 | 28 | 12 |
| 6 | styrene | H | $C_6H_5CH_2$ | Cl | 60 | 26 | 14 |
| 7 | styrene | H | $C_6H_5CH_2$ | Cl | 60 | 35 | 5 |
| 8 | styrene | H | $C_6H_5CH_2$ | Cl | 50 | 44 | 6 |
| 9 | methyl methacrylate | H | $C_6H_5CH_2$ | Cl | 50 | 37.5 | 12.5 |
| 10 | methyl methacrylate | H | $C_6H_5CH_2$ | Cl | 33 | 50 | 17 |
| 11 | butyl acrylate | H | $C_6H_5CH_2$ | Cl | 50 | 37.5 | 12.5 |
| 12 | styrene | H | 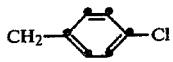 | Cl | 60 | 30 | 10 |
| 13 | styrene | H | $C_6H_{13}$ | Br | 60 | 30 | 10 |
| 14 | styrene | H | $CH_3$ | $CH_3SO_4$ | 60 | 30 | 10 |
| 15 | styrene | H | $CH_3$ | 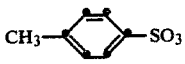 | 60 | 30 | 10 |
| 16 | styrene | H | $CH_2CH_2OH$ | Cl | 60 | 30 | 10 |
| 17 | styrene | H | $C_6H_5CH_2$ | Cl | 50 | 35 | 15 |
| 18 | benzyl methacrylate | H | $C_6H_5CH_2$ | Cl | 50 | 40 | 10 |
| 19 | benzyl acrylate | H | $C_6H_5CH_2$ | Cl | 50 | 40 | 10 |
| 20 | styrene | H | $C_6H_{13}$ | Br | 50 | 35 | 15 |
| 21 | styrene | H | $C_6H_{13}$ | Br | 50 | 40 | 10 |
| 22 | styrene | H | $CH_2CH_2OH$ | Cl | 50 | 35 | 15 |
| 23 | styrene | H | $CH_2CH_2OH$ | Cl | 50 | 40 | 10 |
| 24 | styrene | H | $C_6H_5CH_2$ | Cl | 50 | 40 | 10 |
| 25 | 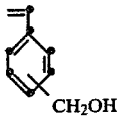 | H | $C_6H_5CH_2$ | Cl | 60 | 30 | 10 |
| 26 | 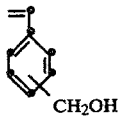 | H | $C_6H_5CH_2$ | Cl | 50 | 40 | 10 |
| 27 | styrene | H | $C_6H_5CH_2$ | Cl | 40 | 52.5 | 7.5 |
| 28 | styrene | H | $C_6H_5CH_2$ | Cl | 40 | 45 | 15 |

EXAMPLES 1–5

Image receiving elements according to the invention were prepared by coating a transparent poly(ethyleneterephthalate) film support with:

(1) a layer containing gelatin at 100 mg/ft$^2$ (1.08 g/m$^2$) and $NiSO_4.6H_2O$ at 54 mg/ft$^2$ (0.58 g/m$^2$);

(2) a mordant layer containing gelatin at 200 mg/ft$^2$ (2.16 g/m$^2$) and a polymeric mordant (see Table II);

(3) an overcoat layer containing gelatin at 50 mg/ft$^2$ (0.54 g/m$^2$) and bis-vinylsulfonylmethyl ether coated at 2.0 weight percent of total gelatin.

To test for the retention of nickel ion, samples of each receiver element were analyzed for nickel by x-ray fluorescence, then washed in water for one hour and reanalyzed. For comparison, similar elements containing polymers outside the scope of the invention were also tested.

This demonstrates the capability of the polymer to complex with the mobile nickel ion initially coated in the sublayer, therefore predetermining the effect of said receiver in preventing the unwanted migration of metal ion when incorporated into an integral imaging-receiver color transfer material.

Results are recorded in Table II.

TABLE II

| | Mordant Example | Conc (g/m$^2$) | $Ni^{+2}$ Analysis Before Wash (mg/m$^2$) | After Wash (mg/m$^2$) |
|---|---|---|---|---|
| control A | poly-4-vinylpyridine | 2.16 | 125 | 31.3 |
| 1 | Polymer No. 14 | 3.11 | 125 | 49.7 |
| 2 | Polymer No. 16 | 3.26 | 125 | 65.9 |
| 3 | Polymer No. 13 | 3.21 | 125 | 43.2 |
| 4 | Polymer No. 12 | 3.24 | 121 | 41.0 |
| 5 | Polymer No. 27 | 3.24 | 121 | 45.4 |
| control B | poly(styrene-co-vinylbenzyl chloride-co-N-benzyl-N,N- | 2.29 | 132 | 5.4 |

TABLE II-continued

| Mordant | | $Ni^{+2}$ Analysis | |
|---|---|---|---|
| Example | Conc ($g/m^2$) | Before Wash ($mg/m^2$) | After Wash ($mg/m^2$) |
| dimethyl-N-vinylbenzyl ammonium chloride-co-divinylbenzene) | | | |

From the data presented in Table II, it is apparent that the receiving layers of the invention are at least as effective in retaining nickel as poly-(4-vinylpyridine), a complexing mordant known to be highly effective in color image transfer elements utilizing metal ions. Further, the results obtained with poly(styrene-co-vinylbenzyl chloride-co-N-benzyl-N,N-dimethyl-N-vinylbenzyl ammonium chloride-co-divinylbenzene) coated in poly(vinyl alcohol) (2.29 $g/m^2$) illustrate that said polymer is ineffective in complexing with nickel.

EXAMPLE 6

An image receiving element was prepared by coating a transparent film support with:

(1) a layer containing gelatin at 100 $mg/ft^2$ (1.08 $g/m^2$) and $NiSO_4.6H_2O$ (0.58 $g/m^2$);

(2) a mordant layer containing gelatin at 200 $mg/ft^2$ (2.16 $g/m^2$) and Polymer No. 17, Table I at 300 $mg/ft^2$ (3.24 $g/m^2$);

(3) a reflecting layer containing titanium dioxide at 1500 $mg/ft^2$ (16.2 $g/m^2$) and gelatin at 240 $mg/ft^2$ (2.5 $g/m^2$);

(4) an overcoat layer containing gelatin at 50 $mg/ft^2$ (0.54 $g/m^2$) and bis-(vinylsulfonylmethyl) ether coated at 2.0 weight percent of total gelatin.

To act as a control, a second element was prepared exactly as above except that Polymer No. 17 was replaced with poly-(4-vinylpyridine) coated at 200 $mg/ft^2$ (2.16 $g/m^2$).

Each element was then evaluated as a receiving element for color image transfer processes employing non-metallizable image dyes by laminating samples to an imagewise exposed photographic element and spreading a viscous processing composition therebetween.

The light-sensitive element was comprised of a transparent poly(ethylene terephthalate) film support having coated thereon:

(1) a photosensitive layer containing a negative-working silver bromide emulsion at 100 mg $Ag/ft^2$ (1.08 $g/m^2$), gelatin at 300 $mg/ft^2$ (3.24 $g/m^2$), and RDR-1* at 44 $mg/ft^2$ (0.48 $g/m^2$) dissolved in diethyl lauramide at 22 $mg/ft^2$ (0.24 $g/m^2$) and dispersed in gelatin;

(2) an overcoat layer containing gelatin at 100 $mg/ft^2$ (0.08 $g/m^2$) and bis-(vinylsulfonylmethyl) ether at 2.0 weight percent based on the total gelatin.

*RDR-1

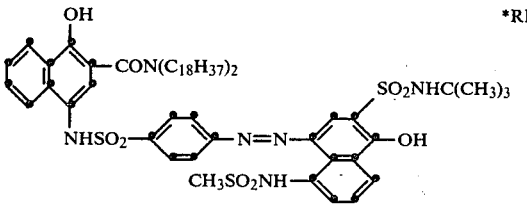

The processing composition contained 62 g of potassium hydroxide, 2.0 g of sodium sulfite, 2 g of 5-methylbenzotriazole, 2.0 g of 4-hydroxymethyl-4-methyl-1-phenyl-3-pyrazolidone, 20 g of potassium bromide and 44 g of carboxymethyl cellulose dissolved in water to make 1.0 liter.

After two minutes, the elements were separated and the receiver samples were washed in water and dried to reveal well-defined magenta dye images.

Sharpness measurements were taken from the images of both dried samples by making an exposure through a metal pressed against a tablet. After processing, a black area appears next to a white area. The dye smears from dark to light and gives a diffuse edge. A microdensitometer is used to measure density point by point across the edge. Dye spread function is determination and the modulation transfer function is generated. The CMT accutance is then determined as described in Mees and James, "The Theory of the Photographic Process," Fourth Edition, Chapter 21, pages 628–633, MacMillan Publishing Company, New York (1977). The samples were then rewet and measured for sharpness both before and after keeping at 140° F./70% RH for 1, 3 and 9 days, respectively. The results are shown in Table III.

TABLE III

| Example | Days | Sharpness (CMT) |
|---|---|---|
| 6 | 1 | 84.5 |
| 6 | 3 | 82.6 |
| 6 | 9 | 81.0 |
| control | 1 | 81.0 |
| control | 3 | 81.3 |
| control | 9 | 78.5 |

From the data obtained, it was apparent that the images were equally as sharp before keeping; however, image dye smearing of the control causes significantly greater degradation of image sharpness than that observed in the receiver of the invention.

EXAMPLE 7

Additional samples of the receiver elements prepared in Example 6 were tested in a color image transfer process utilizing diffusible metallizable dyes released from ballasted electron-accepting nucleophilic displacement (BEND) compounds.

Samples of each receiver element were laminated to an imagewise exposed photographic element comprising:

(1) a photosensitive layer containing a negative-working silver bromide emulsion at 100 $mg/ft^2$ (1.08 $g/m^2$), gelatin at 300 $mg/ft^2$ (3.16 $g/m^2$), BEND-1* at 49 $mg/ft^2$ (0.53 $g/m^2$), and BEND-2** at 120 $mg/ft^2$ (1.30 $g/m^2$);

*BEND-1

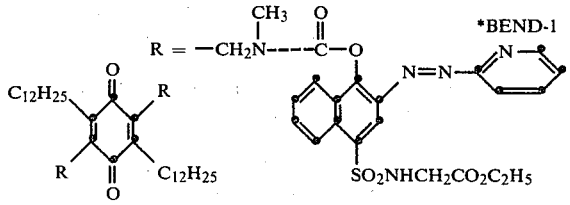

-continued
**BEND-2

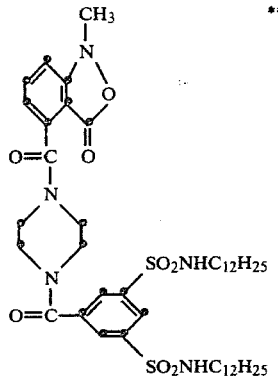

(2) an overcoat layer containing gelatin at 100 mg/ft$^2$ (1.08 g/n$^2$) and bis-(vinylsulfonylmethyl) ether at 1.5 weight percent based on the total gelatin.

Processing was carried out as described in Example 6 employing a viscous composition comprising 51 g of potassium hydroxide, 1.0 g of 5-methylbenzotriazole, 20 g of potassium bromide, 3.0 g of 4-hydroxymethyl-4-methyl-1-phenyl-3-pyrazolidone and 40 g of carboxymethyl cellulose dissolved in water to make 1.0 liter.

After processing, well-defined images were observed in both receiver elements. In view of dye hue and stability, it was apparent that the receiver of the invention was effective in metallizing the transferred dye, as was the control. Sharpness measurements obtained as described in Example 6 showed slightly sharper images in the receiver of the invention, with very little degradation in sharpness seen in either receiver after incubation.

The invention has been described in detail with particular reference to preferred embodiments thereof, but it will be understood that variations and modifications can be effected within the spirit and scope of the invention.

We claim:

1. In an image transfer film unit to be processed by an alkaline processing composition, said film unit comprising:

(1) a support having thereon at least one layer containing a photosensitive silver halide emulsion having associated therewith a dye-forming material; and (2) a dye image-receiving layer located between said support and said layers containing the silver halide emulsion;

the improvement wherein the dye image-receiving layer contains a copolymer having the recurring units

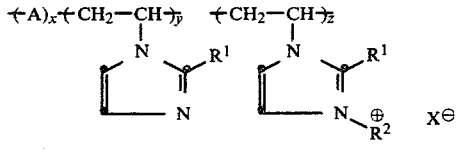

wherein:

A is a unit derived from an ethylenically unsaturated monomer;

$R^1$ is H, alkyl or alkyl substituted with a metal-coordinating group or salts thereof;

$R^2$ is alkyl or aralkyl;

$X^{\ominus}$ is an acid anion;

x is 10 to 80 mole percent;

y is 10 to 80 mole percent; and z is 5 to 20 mole percent;

said polymer having associated therewith metal ions, said metal ions being either in the same layer as the polymer or in a layer between the support and the layer containing said polymer.

2. In an image transfer film unit comprising:

(1) a support containing thereon at least one layer containing a photosensitive silver halide emulsion having associated therewith a dye-forming material;

(2) a dye image-receiving layer located between said support and said layers containing the silver halide emulsion; and (3) an alkaline processing composition and means for discharging same within said film unit in contact with said photosensitive layer;

said film unit containing a silver halide developing agent, the improvement wherein the dye image-receiving layer contains a copolymer having the recurring units

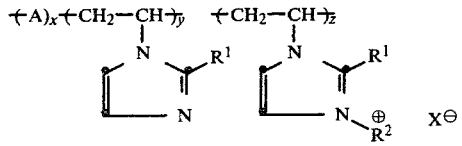

wherein:

A is a unit derived from an ethylenically unsaturated monomer;

$R^1$ is H, alkyl or alkyl substituted with a metal-coordinating group or salts thereof;

$R^2$ is alkyl or aralkyl;

$X^{\ominus}$ is an acid anion;

x is 10 to 80 mole percent;

y is 10 to 80 mole percent; and z is 5 to 20 mole percent;

said polymer having associated therewith metal ions, said metal ions being either in the same layer as the polymer or in a layer between the layer containing said polymer and the support.

3. The film unit of claim 2 wherein $R^1$ is selected from the group consisting of hydrogen and methyl.

4. The film unit of claim 2 wherein A is styrene.

5. The film unit of claim 2 wherein the metal ions are selected from the group consisting of nickel, copper, zinc and cobalt.

6. The film unit of claim 2 wherein the film unit is an integral image transfer film unit.

7. The film unit of claim 2 wherein said dye or dye-forming material is a chelating dye or dye-forming material.

8. In an image transfer unit comprising:

(1) a support containing thereon at least one layer containing a photosensitive silver halide emulsion having associated therewith a dye-forming material;

(2) a dye image-receiving layer located between said support and said layers containing the silver halide emulsion; and (3) an alkaline processing composition and means for discharging same within said film unit in contact with said photosensitive silver halide emulsion;

(4) a neutralizing layer for neutralizing said alkaline processing composition; and (5) a barrier which is permeable by said alkaline processing composition after a predetermined time, located between said neutralizing layer and said photosensitive silver halide emulsion;

said film unit containing a silver halide developing agent, the improvement wherein the dye image-receiving layer comprises a copolymer having recurring units

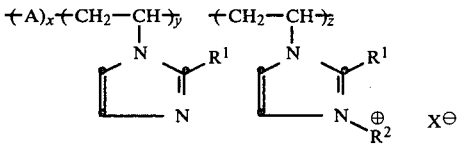

wherein:

A is a unit derived from an ethylenically unsaturated monomer;

$R^1$ is H, alkyl or alkyl substituted with a metal-coordinating group or salts thereof;

$R^2$ is alkyl or aralkyl;

$X^{\ominus}$ is an acid anion;

x is 10 to 80 mole percent;

y is 10 to 80 mole percent; and z is 5 to 20 mole percent;

said polymer having associated therewith metal ions, said metal ions being either in the same layer as the polymer or in a layer between the layer containing said polymer and the support.

9. The film unit of claim 8 wherein said dye or dye-forming material is a chelating dye or dye-forming material.

10. In an integral photographic assemblage comprising:

(a) a photosensitive element comprising a transparent support (1) having thereon the following layers in sequence: a dye image-receiving layer, an alkaline solution-permeable, light-reflective layer, an alkaline solution-permeable, opaque layer, a red-sensitive silver halide emulsion layer having a ballasted cyan dye releaser associated therewith, a green-sensitive silver halide emulsion layer having a ballasted magenta dye releaser associated therewith, and a blue-sensitive silver halide emulsion layer having a ballasted yellow dye releaser associated therewith;

(b) a transparent sheet superposed over said blue-sensitive silver halide emulsion layer and comprising a transparent support (2) having thereon, in sequence, a neutralizing layer and a timing layer; and (c) a rupturable container containing an alkaline processing composition and an opacifying agent which is so positioned during processing of said assemblage that a compressive force applied to said container will effect a discharge of the container's contents between said transparent sheet and said blue-sensitive silver halide emulsion layer; said assemblage containing a silver halide developing agent; the improvement wherein said dye image-receiving layer contains a copolymer having the recurring units

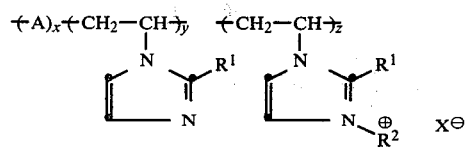

wherein:

A is a unit derived from an ethylenically unsaturated monomer;

$R^1$ is H, alkyl or alkyl substituted with a metal-coordinating group or salts thereof;

$R^2$ is alkyl or aralkyl;

$X^{\ominus}$ is an acid anion;

x is 10 to 80 mole percent;

y is 10 to 80 mole percent; and z is 5 to 20 mole percent;

said polymer having associated therewith metal ions, said metal ions being either in the same layer as the polymer or between said layer containing said polymer and the (1) support.

11. The assemblage of claim 10 wherein said polymer and metal ions are located in the same layer.

12. In a process of producing a photographic transfer image in a photographic element comprising a support having thereon at least one imagewise exposed photosensitive silver halide emulsion layer having associated therewith a dye or dye-forming material and an image-receiving layer located between said support and said silver halide emulsion layers, comprising:

treating said element with an alkaline processing composition in the presence of a silver halide developing agent to effect development of each of said exposed silver halide emulsion layer;

(1) an imagewise distribution of dye or dye-forming materials being formed as a function of development; and (2) at least a portion of said imagewise distribution of dye or dye-forming material diffusing to said dye image-receiving layer;

the improvement wherein said dye image-receiving layer contains a copolymer having the recurring units

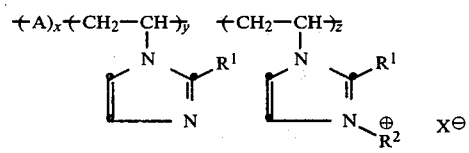

wherein:

A is a unit derived from an ethylenically unsaturated monomer;

$R^1$ is H, alkyl or alkyl substituted with a metal-coordinating group or salts thereof;

$R^2$ is alkyl or aralkyl;

$X^{\ominus}$ is an acid anion;

X is 10 to 80 mole percent;

y is 10 to 80 mole percent; and z is 5 to 20 mole percent;

said polymer having associated therewith metal ions, said metal ions being either in the same layer as the polymer or in a layer between said layer containing said polymer and the support.

13. The process of claim 12 wherein the dye or dye-forming material is a chelating dye or dye-forming material.

14. A photographic image transfer film unit comprising a support containing thereon at least one layer containing a photosensitive silver halide emulsion having associated therewith a dye-forming material, and a receiving layer, located between said support and said layers containing photosensitive silver halide emulsion, said receiving layer containing a complex containing metal coordinated to a copolymer having recurring units

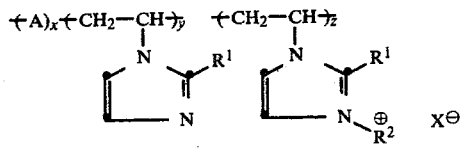

wherein:

A is a unit derived from an ethylenically unsaturated monomer;

$R^1$ is H, alkyl or alkyl substituted with a metal-coordinating group or salts thereof;

$R^2$ is alkyl or aralkyl;

$X^{\ominus}$ is an acid anion;

x is 10 to 80 mole percent;

y is 10 to 80 mole percent; and z is 5 to 20 mole percent.

15. The element of claim 14 wherein the metal is chelated by a dye or dye-forming material and by said polymer.

* * * * *